United States Patent [19]

Discavage

[11] 4,328,742

[45] May 11, 1982

[54] STRAPPING APPARATUS FEED AND TENSION MECHANISM

[75] Inventor: James L. Discavage, Essington, Pa.

[73] Assignee: Cyklop Strapping Corp., Downingtown, Pa.

[21] Appl. No.: 124,027

[22] Filed: Feb. 25, 1980

[51] Int. Cl.[3] ..... B65B 13/22

[52] U.S. Cl. ..... 100/32; 100/33 PB; 226/51; 226/183

[58] Field of Search ..... 100/2, 8, 26, 31, 32, 100/33 R, 33 PB, 29, 30; 228/49, 51, 181, 183, 188; 156/468, 515

[56] References Cited

U.S. PATENT DOCUMENTS

| | | | |
|---|---|---|---|
| Re. 27,744 | 8/1973 | Billett et al. | 100/8 |
| 2,194,108 | 3/1940 | Wright | 100/26 |
| 2,438,386 | 3/1948 | Chamberlain | 100/31 |
| 3,420,158 | 1/1969 | Kobiella | 100/2 |
| 3,442,203 | 5/1969 | Kobiella | 100/26 |
| 3,590,729 | 7/1971 | Plattner | 100/32 |
| 3,847,071 | 11/1974 | Goodley | 100/32 |
| 4,212,238 | 7/1980 | Simmons | 100/32 |

FOREIGN PATENT DOCUMENTS

| | | | |
|---|---|---|---|
| 1161827 | 8/1969 | United Kingdom | 100/26 |

*Primary Examiner*—Billy J. Wilhite

*Attorney, Agent, or Firm*—Eugene G. Horsky; Robert S. Lipton

[57] ABSTRACT

A mechanism for use in a strapping apparatus including a pair of like rolls which have meshing gears as flanges and which are rotated by a drive means through a clutch system to both feed and tension strap without stopping or reversing the drive means. Strap is laced about and nipped by the rolls and, as the rolls rotate at the same speed and the roll flanges travel with the strap, abrasion along the strap sides and edges is avoided.

15 Claims, 7 Drawing Figures

STRAPPING APPARATUS FEED AND TENSION MECHANISM

The present invention relates to strapping apparatus, and particularly, to an improved mechanism for feeding strap from a supply for application as a loop around an article and, after the leading end of the strap has been gripped, for tensioning the strap loop onto such article.

In typical strap feed and tension mechanisms of known strapping machines, strap from a supply is engaged by two or more rolls or wheels, at least one of which is positively driven, as by a reversible motor, to effect strap advancement and retraction. With such mechanisms, motion is transmitted to the strap simply by nipping the strap by the rolls, or by the traction exerted on the strap by substantial portions of the roll surfaces, or by both nipping of the strap and exerting traction along significant lengths thereof. U.S. Pat. Nos. 3,420,158; 3,590,729;and U.S. Pat. No. Re. 27,744 describe strap feed and tension mechanisms which are illustrative of those employed in conventional strapping machines.

In the absence of separate motors for strap feeding and tensioning, typical strap feed and tension mechanisms utilize reversing motors and related controls, complex gear box transmissions, or combinations of electric or pneumatic clutch brakes, all of which are complicated and expensive both as to initial cost and maintenance.

Moreover, while such conventional strap feed and tension mechanisms serve well with metallic strap, their performance with plastic strap is not entirely satisfactory. For example, movement of the rolls of such mechanisms at different speeds is not uncommon and will tend to abrade plastic strap, often disturbing the molecular orientation imparted to such strap and perhaps weakening the strap, marring its surface to such an extent as to make subsequent strap feeding at least difficult, and creating plastic dust particles which may also interfere with strap transit and/or cause various mechanisms and controls of the strapping machine to malfunction.

Still further, stationary surfaces adjacent to the rolls of known strap feed and tension mechanisms cause the edges of plastic strap to abrade, creating still more plastic dust, and are themselves eroded by the strap edges, especially in areas at which such rolls nip the plastic strap. The grooving of stationary machine surfaces by the travelling plastic or metallic strap ultimately interferes with the strap movement. While such erosion can be delayed by expensive surface treatments applied to these stationary members, it remains an annoyance to both the strapping machine manufacturer and user.

Accordingly, a primary object of this invention is the provision of a strapping apparatus having a generally new or improved and more satisfactory strap feed and tension mechanism.

Another object is to provide for use in a strapping apparatus an improved strap feed and tension mechanism in which substantially like rolls are rotated at like speeds and serve also to guide a travelling strap without any apparent relative movement between such strap and rolls.

Still another object is to provide for use in a strapping apparatus an improved strap feed and tension mechanism in which a single motor, driven in only one direction, serves to rotate a pair of rolls selectively in opposite directions to effect strap feeding and tensioning.

These and other objects are accomplished in accordance with the present invention by providing for use in a strapping apparatus a strap feed and tension mechanism which includes a pair of rolls having peripheral surfaces of substantially like diameter for engaging with a strap, and meshing gears fixed as flanges to such rolls and having pitch diameters substantially equal to the diameters of the roll peripheral surfaces. Included also as part of this mechanism is a drive means for rotating one of the rolls selectively in opposite directions, whereby the meshing gears insure that both rolls rotate at the same speed during strap feeding and tensioning so that abrasion of strap surfaces is avoided. As roll flanges, the meshing gears assist in the guidance of the strap during the feeding and tensioning thereof, without the need of stationary edge guides and without any appreciable relative movement between the roll flanges and strap as would abrade the strap edges.

The strap feed and tension mechanism of this invention is particularly adapted for use with molecularly oriented plastic strap formed, for example, of polypropylene, polyester, and nylon, and is hereafter described as employed with such plastic strap.

The peripheral surface of one of the rolls, and preferably both rolls, of the mechanism is defined by a covering of elastomeric material, and the rolls themselves are positioned so that their peripheral surfaces contact without interference. Thus, straps of different thickness or strap having thickness variations along its length are effectively nipped by the cooperating rolls. For ease and simplicity, the mechanism is hereafter described with coverings of elastomeric material on the peripheral surfaces of both of such rolls.

The mechanism also includes tracks that cooperate with the peripheral surfaces of the rolls in defining a serpentine strap passage along which the strap is wrapped about substantial portions of the roll peripheries. The snug and substantial grip of the strap by the peripheral roll coverings of elastic material, taken with the nipping of the strap by the rolls, at least minimizes strap slippage, particularly during strap tensioning.

The rolls of this mechanism are carried by shafts, which are part of the drive means, with one of such rolls mounted as an idler on a first shaft, and the other fixed to the second shaft. A single drive motor, which during use of the strapping apparatus rotates in but one direction, continuously rotates the first shaft. Feed and tension jaw clutch faced members are rotatably mounted on the second shaft and are driven in opposite directions from the first shaft. A double faced shifter jaw clutch is splined to the second shaft and is moveable selectively into engagement with the feed and tension jaw clutch faced members to thereby transmit rotation to the second shaft and the geared rolls and provide for strap feeding and tensioning.

More particularly, the feed jaw clutch faced member includes a bearing mounted spur gear which meshes with and is driven by a spur gear fixed to the continuously rotating first shaft, while the tension jaw clutch faced member includes a bearing mounted timing belt pulley which is driven by a timing belt laced over a pulley fixed to the first shaft. The timing belt serves an added function in this mechanism in that sensing means, responsive to the removal of slack in one reach of such belt during strap tensioning, conditions the strapping apparatus for performing operations subsequent to strap tensioning.

Figures 1, 3, 4:
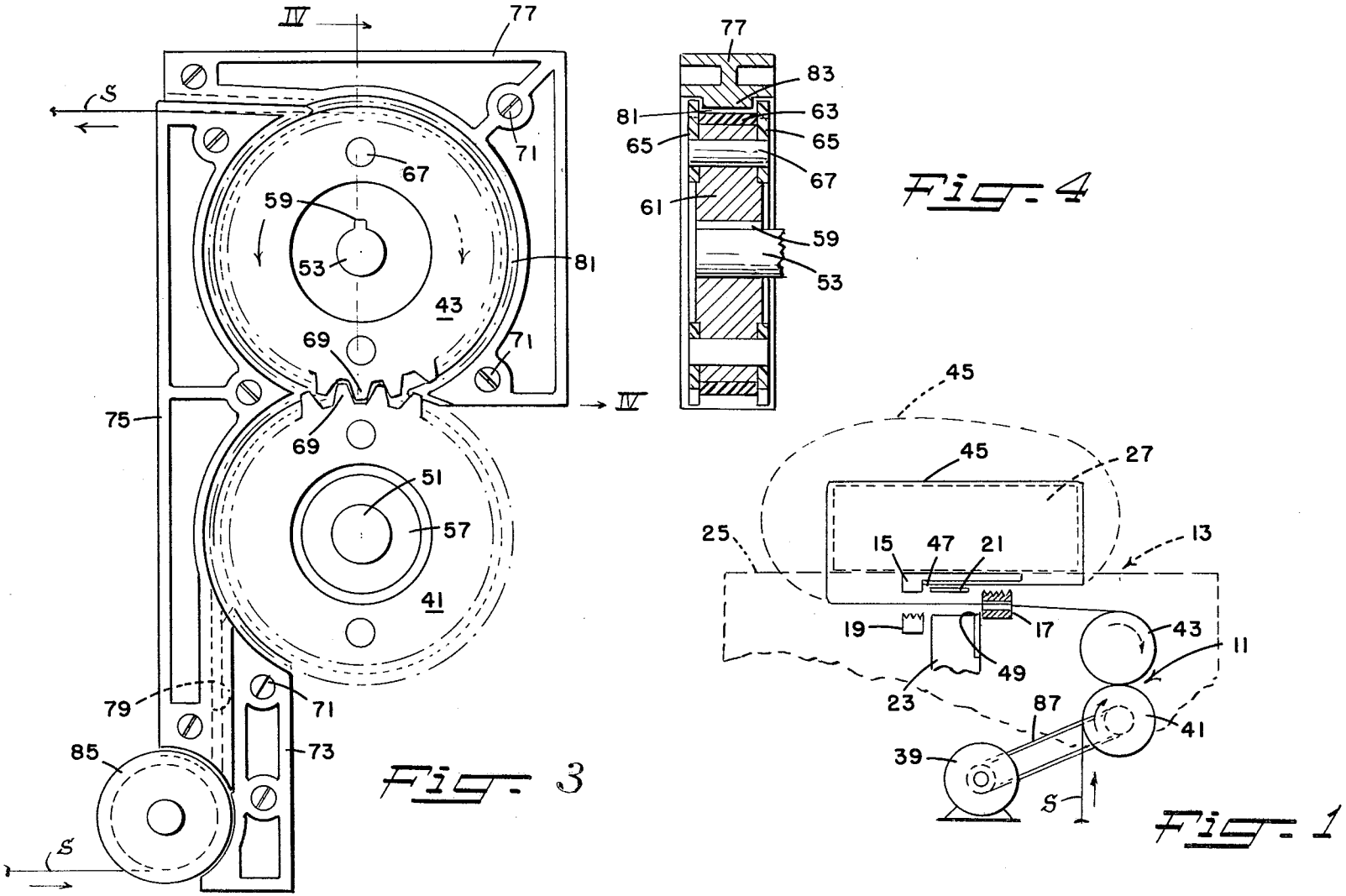
FIG. 1 is a diagrammatic illustration of a strapping apparatus incorporating the strap feed and tension mechanism of the present invention.
FIG. 3 is a front view of the mechanism shown in FIG. 2.
FIG. 4 is a vertical section taken along the line IV—IV of FIG. 3.

Referring to FIG. 1, indicated at 11 is the strap feed and tension mechanism of the present invention as incorporated into a conventional strapping apparatus having a main frame, denoted generally by reference character 13, a retractable anvil 15, strap grippers 17 and 19, a heat seal blade 21, and a platen 23. The main frame 13 includes a table 25, on which an article 27 is supported during strapping, a base 29, rear wall 31, and transverse vertical walls 33 and 35. In such conventional strapping apparatus the anvil 15, grippers 17 and 19, heat seal blade 21, and platen 23 are operated in proper sequence by a series of cams fixed to a shaft 37, shown in FIG. 6, which is rotated by a drive motor 39.

Referring again to FIG. 1, strap S is drawn from a suitable supply by rolls 41 and 43 of the mechanism 11, and passed along a path as illustrated to provide a strap loop 45 about the article 27. In such conventional strapping apparatus, entry of the free end portion 47 of strap S into its position shown in FIG. 1 actuates a switch, not shown, which signals for rotation of the cam shaft 37 to first elevate the gripper 17, thereby fixing the strap against the anvil 15, and then rotation of the rolls 41 and 43 to tension the strap loop 45 onto the article 27. With continued rotation of the shaft 37, cams thereon elevate the gripper 19 to fix the tensioned strap loop against the anvil 15, stop the rotation of the rolls 41 and 43, and project the heat seal blade 21 between overlying strap portions. With still further rotation of the shaft 37, a cam causes the platen 23 to rise, first to have a blade 49 thereon and the gripper 17 shear the strap S, next to press the overlying strap portions snugly against the blade 21 and, after the blade 21 is retracted, to press such heated strap portions together. After the platen 23 and grippers 17 and 19 are retracted, the anvil 15 is also retracted to permit the strapped article to be removed. Upon return of the anvil 15 to its initial position, the rolls 41 and 43 are again rotated to feed a predetermined length of strap S from the supply source.

The rolls 41 and 43 of the mechanism 11 rotate in opposite directions, with the rolls 41 and 43 turning clockwise during the respective strap feeding and tensioning stages, as shown in FIG. 1. For ease of description, it will be understood that mention of a particular direction of movement of elements of the strapping apparatus and mechanism 11 will be as viewed in the Figures of the drawing to which reference is made.

Figure 2:
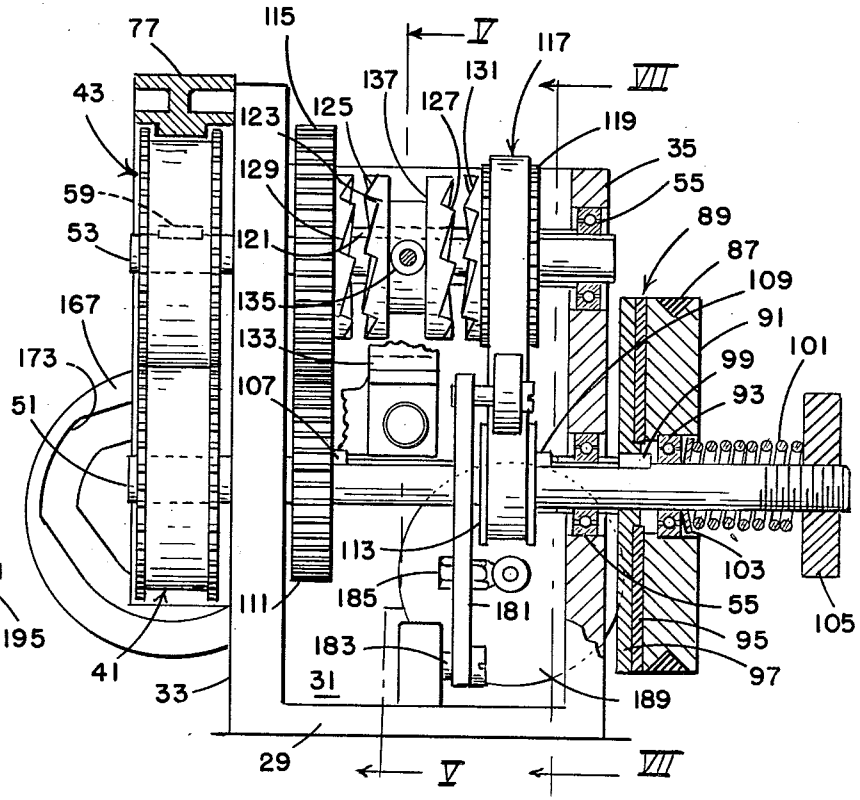
FIG. 2 is an end view of the mechanism of this invention as seen from the right side of FIG. 1, with certain elements removed and portions thereof being broken away to illustrate internal elements.

With reference to FIGS. 2–4, the rolls 41 and 43 are carried by shafts 51 and 53, respectively, which are mounted by bearings 55 for rotation relative to walls 33 and 35 of the main frame 13. The roll 41 is an idler roll and is mounted on the shaft 51 by a bearing 57, while the roll 43 is a drive roll and is keyed at 59 to the shaft 53. Except as is necessary for accommodating the mounting thereof to the respective shafts 51 and 53, the rolls 41 and 43 are of like construction, each including a core 61, a covering 63 of elastomeric material which defines the roll periphery, and gears 65 which are fixed by pins 67 to opposite sides of the core 61 and serve as roll flanges. The diameters of the rolls 41 and 43, as measured to the peripheries thereof, are essentially alike while the gears 65 fixed to such rolls each have a pitch diameter, as indicated at 69, equal to the roll diameter.

The center distance between the shafts 51 and 53 is equal to the diameter of a roll 41 and 43 so that the roll coverings 63 contact each other without interference but will effectively nip strap of various thickness and, of course, a strap which has thickness variations along its length. Fixed to the main frame 13, as by screws 71, are lower, middle, and upper strap tracks 73, 75, and 77 which cooperate with each other and the peripheries of the rolls 41 and 43 to provide strap passage sections 79 and 81. As shown in FIGS. 2 and 4, the track 77 is formed with a rib 83 which projects in between the gears or flanges 65 of the roll 43 and is spaced from the periphery of such roll so that the passage section 81 permits smooth strap transit along a path which conforms closely with the roll periphery. The portions of the tracks 73 and 75 are similarly shaped to likewise dimension the passage section 79 and an idler roll 85 is provided to insure smooth strap movement into such passage section.

From the description of the mechanism 11 given thus far, it will be noted that, as the rolls 41 and 43 are of like diameter and have like meshing gears 65 of a pitch diameter equal to the roll diameter, the rolls 41 and 43 will at all times rotate at the same speed and, also, that the roll flanges, as defined by the gears 65, and the strap S laced over such rolls will travel at the same speed. Thus, the mechanism 11 essentially avoids abrasion of the strap sides and edges, and, as the strap edges do not engage fixed guides during strap travel with the rolls 41 and 43, no erosion of fixed guides arises. Essentially eliminated by the mechanism 11 is the abrasion of the strap and the creation of dust particles, and completely avoided is the erosion of strap guide surfaces, all of which are long standing difficulties that are encountered with conventional strap feed and tension mechanisms.

Significant also is that with the center distance of the shafts 51 and 53 being equal to the diameter of a roll 41 and 43, such rolls effectively nip the strap S regardless of thickness variations along the strap length and enable straps of different thicknesses to be used with the mechanism 11. Moreover, the tracks 73, 75, and 77 encourage engagement of the strap with substantial peripheral portions of the rolls 41 and 43 so that significant traction is exerted on the strap S. Thus, strap travel during both feeding and tensioning is smooth, uninterrupted and free of strap buckling. Abrasion of the strap within the mechanism 11 is essentially avoided and dust particles which may arise within such mechanism 11 can readily escape by merely passing between the meshing gears 65.

Again referring to FIG. 2, during operation the shaft 51 is rotated continuously in only one direction by the drive motor 39 through a belt 87 and slip clutch 89. The clutch 89 includes a sheave clutch plate 91, which is mounted by bearing 93 on the shaft 51 and has a disc 95 of polymeric material, and a clutch plate 97 keyed at 99 to the shaft 51. Slippage between the clutch plates 91 and 97 is controlled by a spring 101 that reacts against a Belleville spring washer 103 and, in turn, against the bearing 93 as it is compressed by a knob 105 threaded onto the shaft 51.

Figure 7:
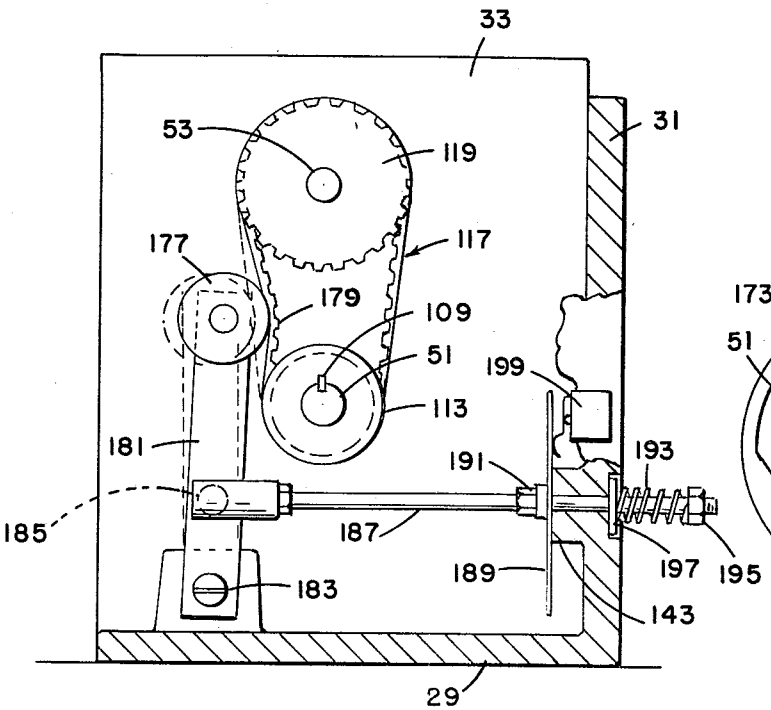
FIG. 7 is a vertical section taken along the line VII—VII of FIG. 2.

Rotation of the slip clutch 89 by the belt 87 drives the shaft 51 continuously in only a clockwise direction, as viewed in FIG. 7. Keyed to the shaft 51 at 107 and 109 are a spur gear 111 and timing belt pulley 113, the gear 111 meshing with a jaw clutch faced spur gear 115 that is bearing mounted on the shaft 53, and the pulley 113 driving a timing belt 117 which rotates a jaw clutch faced timing belt pulley 119 that is also bearing mounted on the shaft 53. Splined to the shaft 53 at 121 is a shifter jaw clutch 123 having teeth at 125 and 127 at opposite ends thereof for engaging with teeth 129 and 131 on the respective jaw clutch faced spur gear 115 and timing belt pulley 119.

While during operation the shaft 51 continuously rotates clockwise, as viewed in FIG. 7, the spur gear 111 and pulley 113 fixed thereto provide for rotation of the bearing mounted jaw clutch faced spur gear 115 and timing belt pulley 119 in counterclockwise and clockwise directions, respectively, relative to the shaft 51. From its neutral position shown in FIG. 2, the shifter jaw clutch 123 is moved along the shaft 53 to the left or right to engage either its teeth 125 or 127 with the teeth 129 or 131 on the respective jaw clutch faced spur gear 115 and timing belt pulley 119. Once so engaged, the shifter jaw clutch 123 will rotate, as will the shaft 53 to which it is splined and the roll 43 fixed to such shaft 53, so that the strap S laced about the rolls 41 and 43 will be urged in a feeding or tensioning direction.

Figure 5:
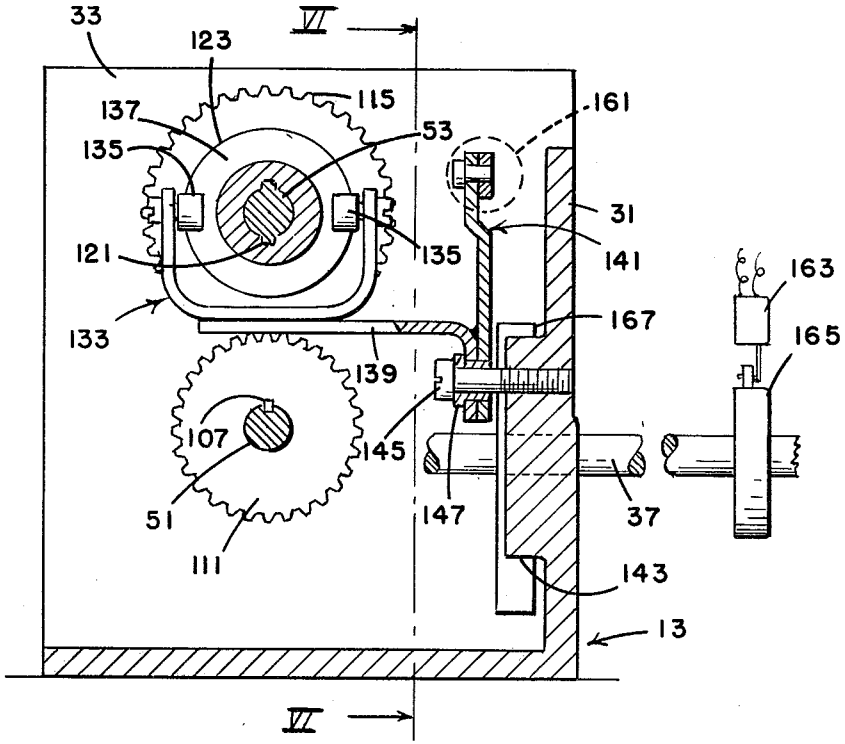
FIG. 5 is a vertical section taken along the line V—V of FIG. 2, with a portion thereof broken away.
Figure 6:
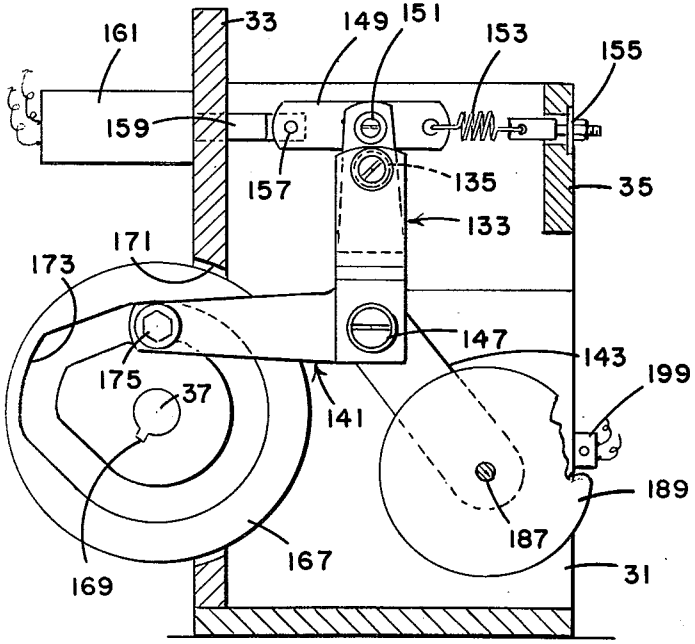
FIG. 6 is a vertical section taken along the line VI—VI of FIG. 5.

With reference to FIGS. 2, 5 and 6, in the illustrated embodiment of the invention movement of the shifter clutch 123 along the shaft 53 is achieved by a yoke 133. Idler rolls 135 on the yoke 133 project into an endless groove 137 formed in the periphery of the clutch 123 so as to facilitate its shifting along the shaft 53 and its rotation by the jaw clutch faced spur gear 115 and timing belt pulley 119. An arm 139 supports the yoke 133 and is fixed to and mounted with a bell crank lever 141 on a projecting portion 143 of the rear wall 31 of the main frame 13. This mounting is best shown in FIG. 5 and includes a bolt 145 and bearing 147 which permit the yoke support arm 139 and bell crank lever 141 to oscillate as a unit and thereby provide for shifting of the clutch 123 along the shaft 53.

As seen in FIG. 6, a link 149 is connected at 151 to one end of the bell crank lever 141 and is, in turn, connected by a tension spring 153 and retainer 155 to the wall 35 of the main frame 13, and by a pivot pin 157 to the plunger 159 of a solenoid 161. The solenoid 161 is mounted on the wall 33 of the main frame 13 is actuated through a switch 163 that is operated by a cam 165 fixed to the shaft 37, as shown in FIG. 5. When so actuated, the solenoid 161 serves to rotate the bell crank lever 141 counterclockwise as viewed in FIG. 6, thereby causing the yoke 133 to shift and engage the clutch 123 with the jaw clutch faced spur gear 115. As heretofore explained, once so engaged the shifter clutch 123 transmits rotation to the shaft 53 and provides for feeding of strap S by the rolls 41 and 43.

As shown in FIG. 6, a cam 167 is keyed at 169 to the cam shaft 37 and extends through an opening 171 in the wall 33 of the main frame 13. A cam groove 173 receives a follower roller which is mounted at 175 to the bell crank lever 141. The contour of the cam groove 173 is such as to permit the solenoid 161 to rotate the bell crank lever 141 as described above and provide for strap feeding, to positively rotate such lever 141 clockwise from its neutral position shown in FIG. 6 to thereby shift the yoke 133 and engage the clutch 123 with the jaw clutch faced timing belt pulley 119 and provide for strap tensioning, and to maintain the bell crank lever 144 in its neutral position during the remainder of the strapping operation, being assisted in this function by the tension spring 153.

As the strap loop 45 shown in FIG. 1 is tensioned onto the article 27, the cam groove 173 assures that the shifter clutch 123 will remain engaged with the jaw clutch faced pulley 119 under the progressively increasing load transmitted by the strap S. The slip clutch 89 prevents overloading of the drive motor during tension stall; that is, during the period that the shaft 37 is rotated to elevate the gripper 19 and shift the yoke 131 and shifter clutch 123 into neutral positions.

Further, as shown in FIGS. 2, 6 and 7 and comprising part of the mechanism 11, an idler roll 177 is provided to sense to the tension in the reach 179 of the timing belt 117 during strap tensioning. The idler roll 177 is carried by a lever 181 which is pivoted at 183 to the main frame 13 and at 185 to a link 187 that extends through the rear wall 33 of such main frame. An actuator plate 189 is adjustably mounted on the link 187 by a nut 191 and by means of a spring 193, nut 195 and bearing washer 197, the link 187 is resiliently loaded to have the actuator plate 189 close a switch 199 when the idler roll 177 is engaged with the reach 179 of the timing belt 117 in its slack condition. The switch 199 controls the rotation of the cam shaft 37 and, thus, during the tension stall; that is, as the lever 181 reacts to the removal of slack in the timing belt reach 179, the switch 199 opens and permits the cam shaft 37 to rotate to raise the gripper 19 and cause the cam 165 to return the bell crank lever 141, yoke 131 and shifter clutch 123 into their neutral positions.

What is claimed is:

1. In a strapping apparatus, a strap feed and tension mechanism including a pair of rolls having peripheral surfaces of substantially like diameter for engaging with opposite sides of a strap, a pair of meshing gears fixed to each of said rolls as flanges on opposite sides thereof, and drive means for rotating one of said rolls, said meshing gears serving as strap guides and also causing said pair of rolls to rotate at substantially the same speed during strap feeding and tensioning to thereby avoid abrasion of the strap.

2. In an apparatus as defined in claim 1 wherein said meshing gears have pitch diameters substantially equal to the diameter of said roll peripheral surfaces whereby said meshing gears, serving as roll flanges, travel at substantially the same speed as the strap and thereby guide without abrading the edges thereof.

3. In an apparatus as defined in claim 2 wherein the roll peripheral surface of at least one of said rolls is defined by a covering of elastometric material, and wherein said rolls are mounted, respectively, on first and second shafts having a center spacing substantially equal to a roll diameter whereby the peripheral surfaces of said rolls contact without interference and are thereby adapted to nip straps of different thicknesses.

4. In an apparatus as defined in claim 3 further including tracks fixed adjacent to and cooperating with the peripheral surfaces of said rolls to define strap passages along which a strap engages with substantial portions of said roll peripheral surfaces.

5. In an apparatus as defined in claim 3 wherein said one roll is fixed to said second shaft and the other of said rolls is mounted as an idler on said first shaft, and wherein said drive means includes a motor for rotating said first shaft in only one direction and clutch means for selectively rotating said second shaft in opposite directions from said first shaft to provide for strap feeding and tensioning by said pair of rolls.

6. In an apparatus as defined in claim 5 wherein said clutch means includes feed and tension clutch members mounted for rotation on said second shaft, means for rotating said feed and tension clutch members in opposite directions from said first shaft, a shifter clutch member mounted on said second shaft for movement in only a longitudinal direction thereof, and means for moving said shifter clutch member from a neutral position selectively into engagement with said feed and tension clutch members.

7. In an apparatus as defined in claim 6 wherein said shifter clutch is mounted on said second shaft between said feed and tension clutch members, and wherein said feed, tension and shifter clutch members are jaw clutch faced members.

8. In an apparatus as defined in claim 7 wherein said jaw clutch faced feed member is a spur gear, and wherein said means for rotating the same is a meshing spur gear fixed to said first shaft.

9. In an apparatus as defined in claim 7 wherein said jaw clutch faced tension member is a timing belt pulley, and wherein said means for rotating the same includes a timing belt pulley fixed to said first shaft and a timing belt laced over said pulleys.

10. In an apparatus as defined in claim 8 wherein said jaw clutch faced tension member is a timing belt pulley, and wherein said means for rotating the same includes a timing belt pulley fixed to said first shaft and a timing belt laced over said pulleys.

11. In a strapping apparatus, a strap feed and tension mechanism including means supporting a first and second shaft for rotation, a pair of rolls having peripheral surfaces for nipping a strap including an idler roll mounted on said first shaft and a drive roll fixed to said second shaft, a pair of meshing gears fixed to each of said rolls as flanges on opposited sides thereof, said gears serving as strap guides and also causing said pair of rolls to rotate at substantially the same speed, and drive means for rotating said first shaft in only one direction and including clutch means for selectively rotating said second shaft in opposite directions from said first shaft to provide for strap feeding and tensioning by said pair of rolls.

12. In an apparatus as defined in claim 11 wherein said clutch means includes feed and tension clutch members mounted for rotation on said second shaft, means for rotating said feed and tension clutch members in opposite directions from said first shaft, a shifter clutch member mounted on said second shaft for movement in only a longitudinal direction thereof, and means for moving said shifter clutch member from a neutral position selectively into engagement with said feed and tension clutch members.

13. In an apparatus as defined in claim 12 wherein said shifter clutch is mounted on said second shaft between said feed and tension clutch members, and wherein said feed, tension and shifter clutch members are jaw clutch faced members.

14. In an apparatus as defined in claim 13 wherein said jaw clutch faced feed member is a spur gear, and wherein said means for rotating the same is a meshing spur gear fixed to said first shaft.

15. In an apparatus as defined in claim 14 wherein said jaw clutch faced tension member is a timing belt pulley, and wherein said means for rotating the same includes a timing belt pulley fixed to said first shaft and a timing belt laced over said pulleys.

* * * * *

UNITED STATES PATENT AND TRADEMARK OFFICE

CERTIFICATE OF CORRECTION

PATENT NO. : 4,328,742

DATED : May 11, 1982

INVENTOR(S) : James L. Discavage

It is certified that error appears in the above-identified patent and that said Letters Patent are hereby corrected as shown below:

--Claim 11, line 9, delete the word "opposited" and insert in its stead the correct spelling opposite.

Signed and Sealed this

Sixteenth Day of November 1982

[SEAL]

Attest:

GERALD J. MOSSINGHOFF

Attesting Officer

Commissioner of Patents and Trademarks